US008133076B2

(12) United States Patent
Nakamura

(10) Patent No.: US 8,133,076 B2
(45) Date of Patent: Mar. 13, 2012

(54) CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/848,414

(22) Filed: Aug. 2, 2010

(65) Prior Publication Data

US 2011/0045696 A1 Feb. 24, 2011

(30) Foreign Application Priority Data

Aug. 18, 2009 (JP) ..... 2009-189030

(51) Int. Cl.
*H01R 13/40* (2006.01)

(52) U.S. Cl. ..... 439/595; 439/587

(58) Field of Classification Search ..... 439/587, 439/595

See application file for complete search history.

(56) References Cited

U.S. PATENT DOCUMENTS

| | | | | |
|---|---|---|---|---|
| 7,059,902 | B2 * | 6/2006 | Nakamura | 439/595 |
| 2011/0045696 | A1 * | 2/2011 | Nakamura | 439/587 |
| 2011/0143566 | A1 * | 6/2011 | Nakamura | 439/271 |

FOREIGN PATENT DOCUMENTS

| | | |
|---|---|---|
| JP | 2005-005135 | 1/2005 |

* cited by examiner

*Primary Examiner* — James Harvey
(74) *Attorney, Agent, or Firm* — Gerald E. Hespos; Michael J. Porco

(57) ABSTRACT

A connector has an inner housing (11) accommodating female terminal fittings (80); an outer housing (12) disposed to surround a periphery of the inner housing (11); and a rubber member (70) disposed to be sandwiched between the inner and outer housings (11, 12). When a mating housing (90) is fit between the inner and outer housings (11, 12), the rubber member (70) is held therebetween and is compressed in a fit-on direction and with a fit-on surfaces of the inner and mating housings (11, 90) kept in contact with each other in a pressed state.

11 Claims, 10 Drawing Sheets

CONNECTOR

BACKGROUND OF THE INVENTION

1. Field of the Invention

The invention relates to a connector.

2. Description of the Related Art

Japanese Patent Application Laid-Open No. 2005-5135 discloses a connector that has a housing and a seal ring. The housing is formed integrally of a housing body and a fit-on tube. The housing body accommodates female terminal fittings and the fit-on tube surrounds the periphery of the housing body. A hood of a mating housing can be fit between the housing body and the fit-on tube. The seal ring closely contacts the housing body and the hood to achieve liquid-tight sealing.

The seal ring is compressed between the peripheral surface of the housing body and the inner peripheral surface of the hood in a direction intersecting the direction in which the housings are fit together. The seal ring also is compressed between a step of the housing body and the front end of the hood in the fit-on direction. The compressed seal ring exerts restoring forces in directions to separate the housings from each other. Accordingly, the housings must be restrained from loosening in the direction in which the housings are fit together so that the terminal fittings accommodated in the housings are not worn by sliding contact therebetween.

A long contact length between mating terminal fittings is advantageous. The above-described Japanese Patent Application Laid-Open No. 2005-5135 achieves stable connection between terminal fittings. However, the restoring elasticity of the seal ring urges the housings in separating directions and decreases the length of the contact portion of the female terminal fitting. Accordingly, the above-described conventional construction makes it difficult to secure an effective contact length.

The invention has been completed based on the above-described situation. It is an object of the invention to secure an effective contact length of a terminal fitting while also preventing housings from loosening.

SUMMARY OF THE INVENTION

The invention relates to a connector having an inner housing that accommodates male terminal fittings, an outer housing disposed to surround a periphery of the inner housing and a rubber member between the inner and outer housings. A mating housing can be fit between the inner and outer housings and compresses the rubber member in a fit-on direction so that fit-on surfaces of the inner housing and the mating housing are kept in contact with each other in a pressed state.

The rubber member preferably is ring-shaped and is fit on a peripheral surface of the inner housing.

An inner lock preferably is formed on the inner housing and an outer lock is formed on the outer housing. The inner and outer locks engage one another to keep the inner and outer housings in a combined state. The inner and outer locks have curved surfaces so that positions of the inner and outer locks can change relative to each other when the inner and outer locks are locked together.

An electric wire drawn outside from the inner housing preferably is connected to the terminal fitting. A cushion is disposed on a periphery of the electric wire and closely contacts an inner peripheral surface of the outer housing.

The rubber member is sandwiched between the inner and outer housings and is held in a compressed state in the fit-on direction when the mating housing is fit on the inner housing.

The fit-on surfaces of the inner housing and the mating housing are in contact with each other in the pressed state. Therefore, the housings will not loosen in the fit-on direction and will not separate from each other. Accordingly, the male and female terminal fittings can be elongated in the longitudinal direction and securely obtain the effective contact length of male and female terminal fittings.

The rubber member preferably is ring-shaped. Thus, the elastic restoring force of the rubber stopper acts uniformly over the entire peripheries of the fit-on surfaces of the inner housing and the mating housing. Therefore it is possible to prevent the fit-in surfaces from contacting one another.

The positions of the inner and outer locking parts can change relative to each other along the curved surface. Accordingly it is possible to prevent the inner housing from following the movement of the outer housing. Consequently, the terminal fitting accommodated in the inner housing will not be worn due to sliding contact between the terminal fitting and the mating male terminal fitting.

The cushion on the periphery of the electric wire closely contacts the inner peripheral surface of the outer housing. When the electric wire vibrates, the vibration force of the wire is transmitted to the outer housing and to the inner housing to prevent the terminal fitting accommodated in the inner housing from being worn due to sliding contact between the terminal fitting and the mating male terminal fitting.

DETAILED DESCRIPTION OF THE PREFERRED EMBODIMENTS

Figure 1:
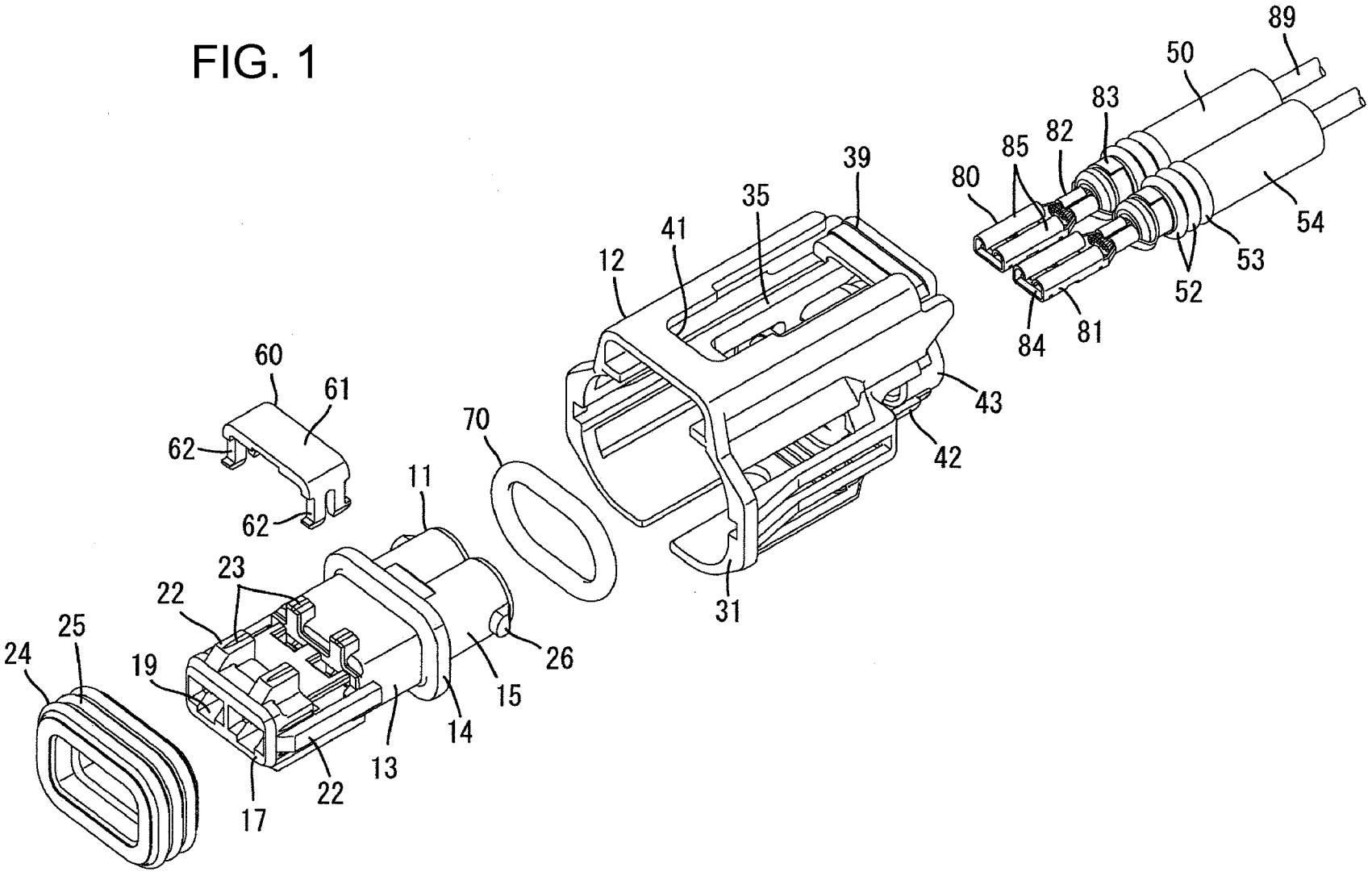
FIG. 1 is an exploded perspective view of a connector of an embodiment 1 of the present invention.

A connector in accordance with the invention has a housing 10, a retainer 60, a rubber member 70, and a female terminal fitting 80, as shown in FIGS. 1 through 10. The housing 10 includes an inner housing 11 and an outer housing 12 and a mating housing 90 can be fit between the inner and outer housings 11 and 12. In the following description, fit-on surfaces of both housings 10 and 90 are referred to as the front in the longitudinal direction. The vertical direction corresponds to the orientation shown in FIG. 3.

Figure 7:
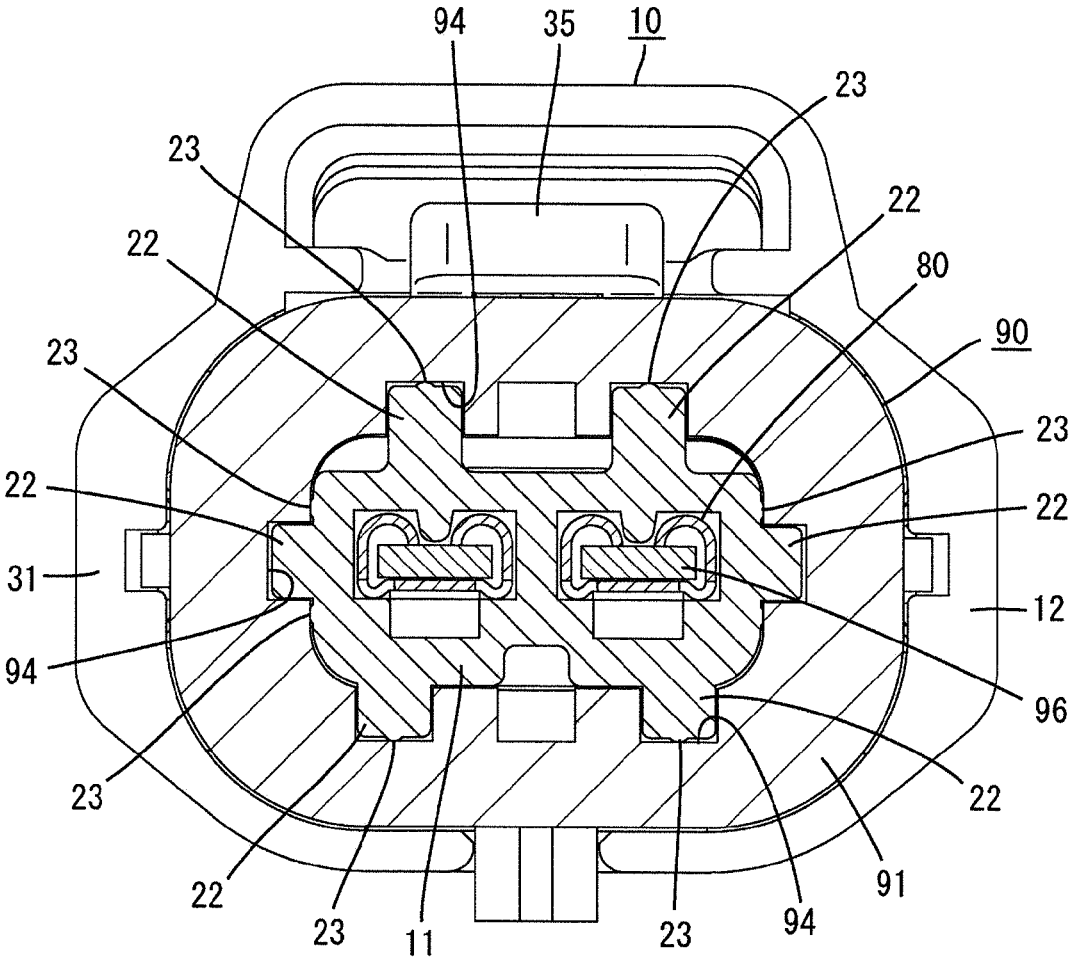
FIG. 7 is a sectional view of the connector normally fitted on a mating housing viewed as viewed front a front side thereof.

The mating housing 90 is made of synthetic resin and is coupled directly to a device. A tubular hood 91 projects forward on the mating housing 90 and a tab 96 of a male terminal fitting 95 projects inside the hood 91. A step 98 is formed on an inner peripheral surface of the hood 91 and a thin portion 92 is formed forward of the step 98. A lock 93 projects from a peripheral surface of an upper wall of the thin portion 92. As shown in FIG. 7, guide grooves 94 are formed on the inner peripheral surface of the hood 91. The guide grooves 94 extend longitudinally and are spaced circumferentially from one another.

Figure 8:
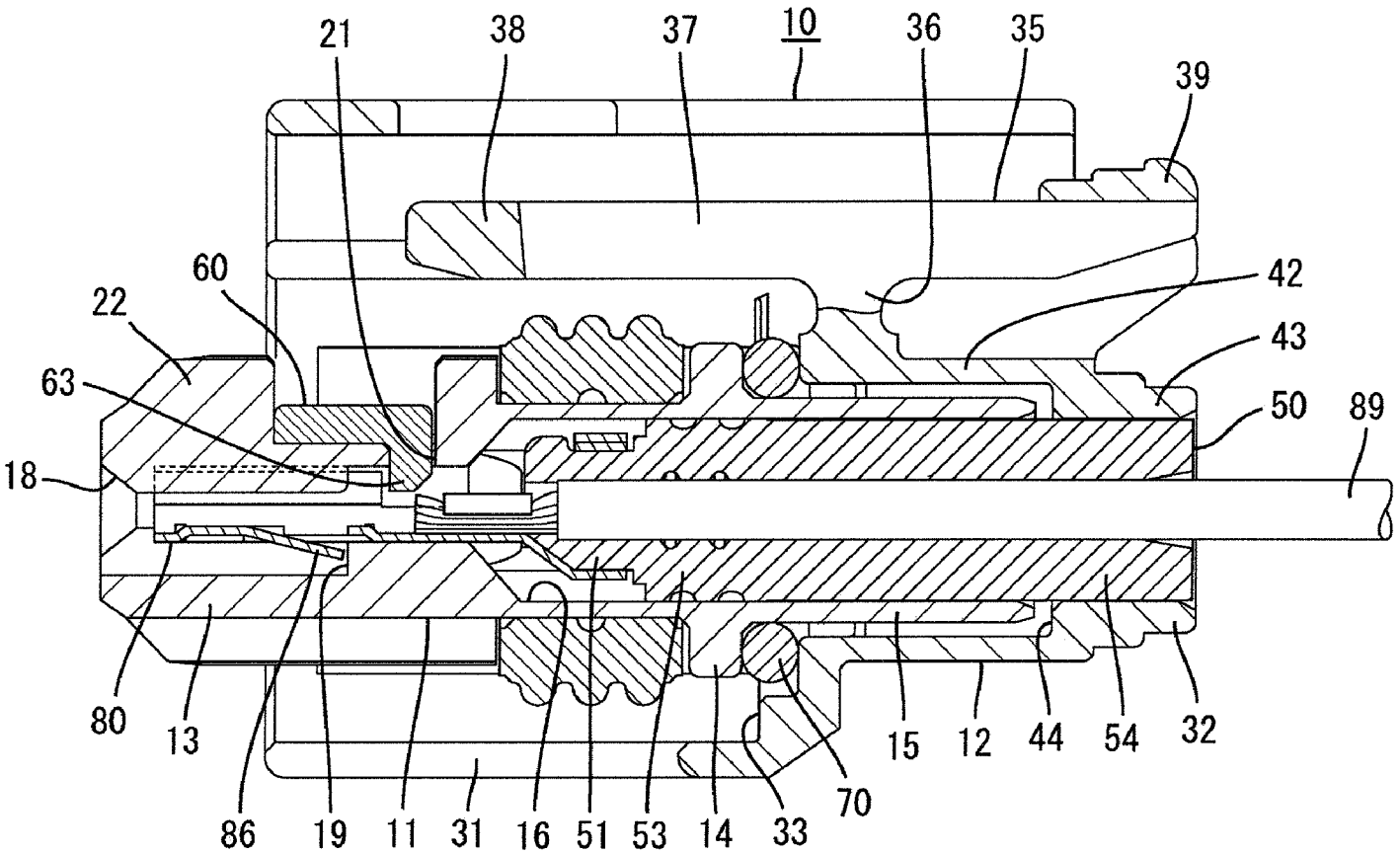
FIG. 8 is a sectional view of the connector.

The inner housing 11 is made unitarily of synthetic resin. As shown in FIGS. 1 and 8, the inner housing 11 has a flat block-shaped inner housing body 13 and a flange 14 protrudes from a rear end of the inner housing body 13. The flange 14 extends over the entire periphery of the inner housing body 13. An inner tube 15 projects rearward from the rear end of the inner housing body 13 and has two tubular bodies coupled to each other.

Cavities 16 extend longitudinally through the inner housing body 13, as shown in FIG. 8, and can accommodate the female terminal fittings 80. The cavities 16 are formed in widthwise pairs and communicate with the inside of the inner tube 15. A front wall 17 is formed on a front surface of each cavity 16. A guide opening 18 is formed on a front surface of the front wall 17, as shown in FIG. 8, and is dimensioned to receive the tab 96. A forwardly facing step 19 is formed on a lower surface of each cavity 16 and communicates with the guide opening 18, as shown in FIG. 8.

An insertion hole 21 is formed through an upper surface of the inner housing body 13 and communicates with the cavity 16, as shown in FIG. 8. A plate-shaped retainer 60 is inserted into the insertion hole 21 from above. The retainer 60 is made of synthetic resin and includes a connection part 61. Two parallel locking pieces 62 project from both widthwise ends of the connection part 61 and a removal prevention piece 63 projects down from a lower surface of the connection part 61. The connection part 61 closes the insertion hole 21 when the retainer 60 is inserted into the insertion hole 21. The locking piece 62 elastically locks an inner side surface of the inner housing body 13 to keep the retainer 60 at a locking position. The removal prevention piece 63 engages the rear of the female terminal fitting 80 and locks the female terminal fitting 80 when the retainer 60 is at the locking position.

Left and right front guide projections 22 and left and right rear guide projections 22 are formed at front and rear positions on the upper surface of the inner housing body 13 so that the insertion hole 21 is sandwiched longitudinally between the front and rear guide projections 22. Guide projections 22 also are formed at both left and right side surfaces of the inner housing 11. Left and right front guide projections 22 and left and right rear guide projections 22 also are formed on a lower surface of the inner housing body 13. The upper and lower guide projections 22 are formed at different positions from each other in the width direction of the inner housing body 13. A longitudinally extending rib 23 is formed on a projected end surface of each of the upper and lower guide projections 22. As shown in FIG. 7, ribs 23 also are formed on both side surfaces of the inner housing body 13 so that the guide projections 22 on the side surfaces of the inner housing body 13 are sandwiched between the ribs 23. Thus eight ribs 23 are disposed circumferentially at certain intervals. Projected ends of the ribs 23 contact the inner peripheral surface of the hood 91 in a crushed state when the mating housing 90 is fit normally on the housing 10 to prevent the inner housing 11 from loosening relative to the mating housing 90.

An annular seal ring 24 is fit on a portion of a peripheral surface of the inner housing 11 between the rear guide projections 22 and the flange 14. The seal ring 24 is made of rubber, such as silicone rubber, and has lips 25 on inner and outer surfaces. The lips 25 are compressed elastically between an inner peripheral surface of the thin portion 92 of the hood 91 and the peripheral surface of the inner housing body 13 to seal the gap between the housings 10, 90 when the mating housing 90 is fit normally on the housing 10. The longitudinal length of the seal ring 24 is set almost equal to the interval between the rear guide projections 22 and the flange 14.

Figure 9:
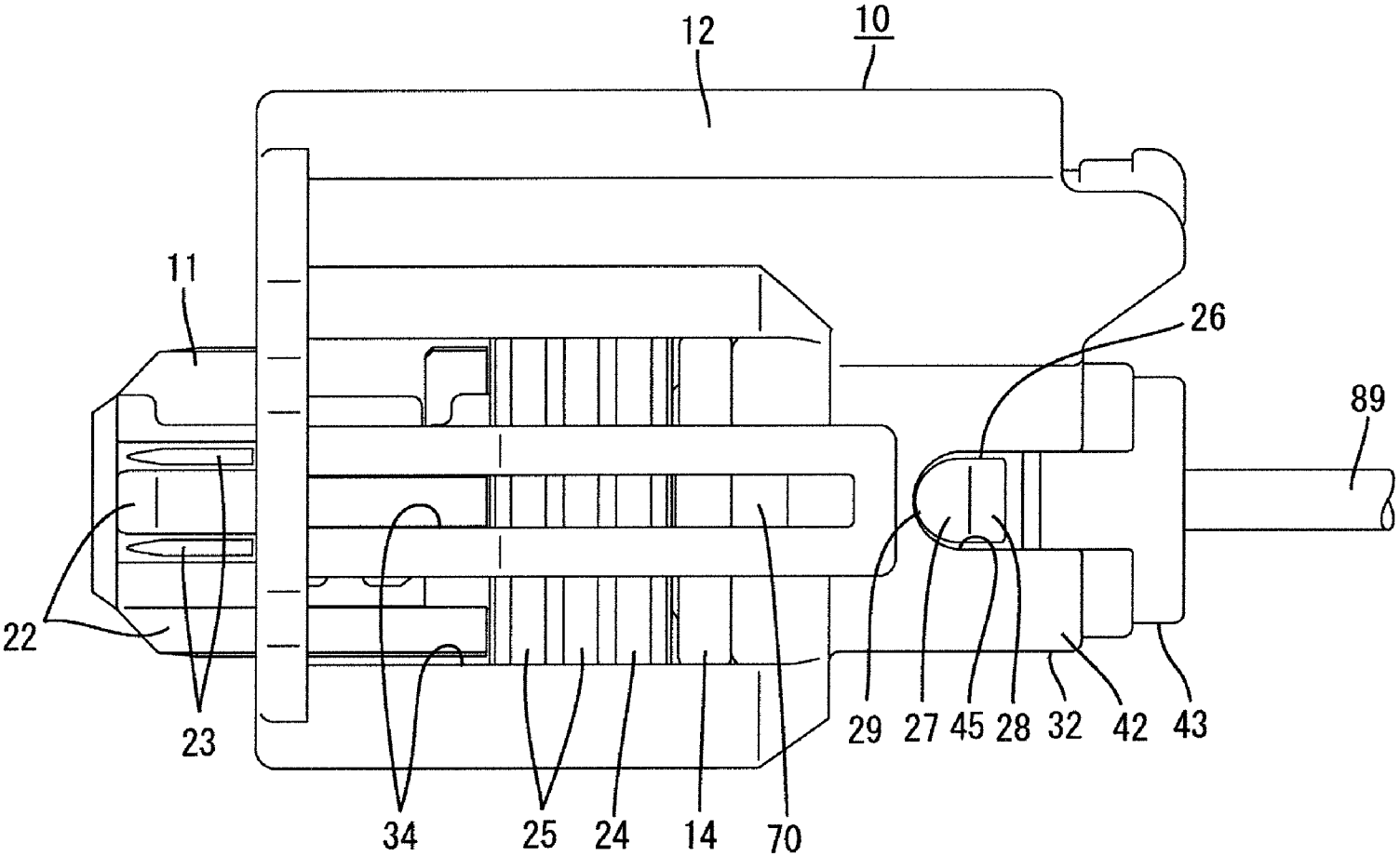
FIG. 9 is a side view of the connector.

Left and right inner locks 26 project at a rear end of both side surfaces of the inner tube 15. As shown in FIG. 9, approximately the front half of each inner lock 26 defines a semicircular columnar inner locking body 27. Approximately the rear half of each inner lock 26 defines a tapered inner locking guide 28. The inner locking body 27 is disposed toward a circular arc-shaped inner engaging surface 29. The inner locking guide 28 slopes down and rearward from a radially extended edge of a projected end surface of the inner locking body 27.

The female terminal fitting 80 is formed unitarily by bending a conductive metal plate. As shown in FIG. 1, the female terminal fitting 80 has a terminal body 81, an open wire barrel 82 continuous with a rear end of the terminal body 81 and an open insulation barrel 83 rearward of the wire barrel 82. The wire barrel 82 is caulked to a core wire exposed at an end of an electric wire 89. The insulation barrel 83 is caulked to the rubber stopper 50 fit at the end of the electric wire 89. The terminal body 81 has a flat receiving plate 84 and two connection pieces 85 curved toward the center of the receiving plate 84 from both sides thereof. Thus, the terminal body 81 is approximately heart-shaped. The tab 96 of the mating male terminal fitting 95 is sandwiched elastically between front ends of the contact pieces 85 and the receiving plate 84 when the mating housing 90 is fit on the housing 10. Thus, both terminal fittings 80 and 95 are connected electrically to each other. A lance (see FIG. 8) 86 is raised from the receiving plate 84 and opens rearward. The front end of the lance 86 elastically locks an inward surface of the step 19 of the cavity 16 when the female terminal fitting 80 is inserted normally into the cavity 16 for primary locking of the female terminal fitting 80. The removal prevention piece 63 is disposed to lock the rear ends of both contact pieces 85 of the terminal body 81 when the retainer 60 reaches the locking position for redundantly locking the female terminal fitting 80.

The rubber stopper 50 is made of rubber, such as silicone rubber, and defines a long narrow tube. The rubber stopper 50 has a thin to-be-caulked portion 51 to be caulked to the insulation barrel 83. A sealing part 53 is rearward of the to-be-caulked portion 51 and has lips 52 that project in and out. A cushion 54 extends rearward from a rear end of the sealing part 53. The to-be-caulked portion 51 and the sealing part 53 are inserted into a portion of the cavity 16 at the side of the inner housing body 13, whereas the cushion 54 is inserted into a portion of the cavity 16 at the side of the inner tube 15. A rear end of the cushion 54 is rearward from a rear end of the inner tube 15 and is in an outer tube 32. The sealing part 53 is compressed elastically between the electric wire 89 and the inner peripheral surface of the cavity 16 to seal the inside of the cavity 16 when the female terminal fitting 80 is inserted normally into the cavity 16. At this time, the peripheral surface of the cushion 54 closely contacts the inner peripheral surface of the inner tube 15.

The outer housing 12 has an outer housing body 31 and the outer tube 32 is continuous with a rear end of the outer housing body 31. The outer housing body 31 surrounds the periphery of the inner housing body 13 and the outer tube 32 surrounds the periphery of the inner tube 15. The outer housing body 31 and the outer tube 32 are coupled via a step 33 that extends orthogonal to fit-on direction. Longitudinal bores 34 extend through the outer housing body 31 at circumferentially spaced intervals.

Figure 10:
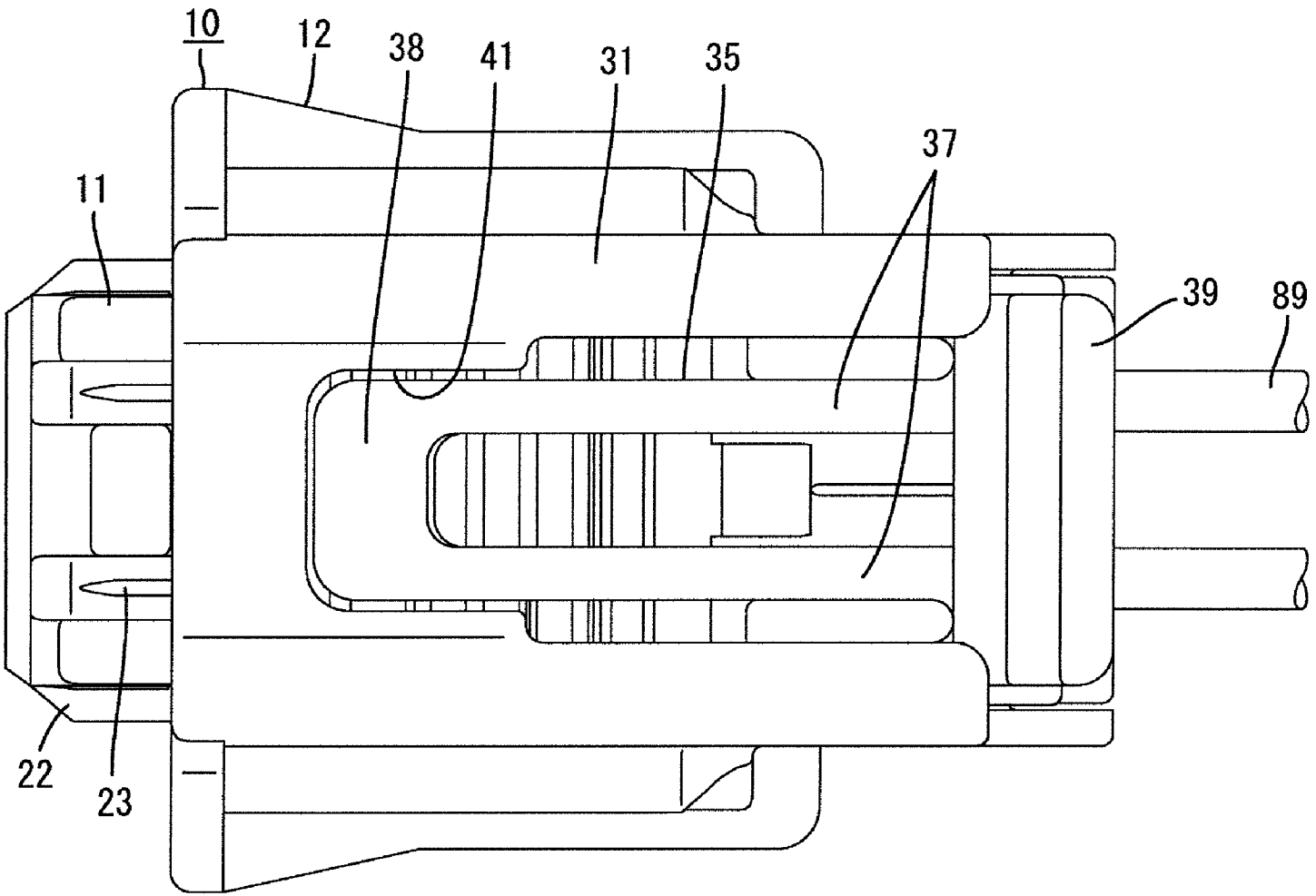
FIG. 10 is a plan view of the connector.

A flexible locking arm 35 is coupled to a front end of an upper surface of the outer tube 32. The locking arm 35 has two supports 36 that rise from the front end of the upper surface of the outer tube 32, as shown in FIG. 8, and arms 37 extend forward and rearward from upper ends of the respective supports 36. A locking body 38 connects front ends of both arms 37 and an unlocking operation part 39 connects rear ends of the arms 37. The arms 37 can pivot elastically and displace about the supports 36. The locking body 38 engages the lock 93 when the mating housing 90 is fit on the housing 10 to hold the housings 10 and 90 together. The unlocking operation part 39 is slightly higher than the arms 37 and the locking body part 38 and can be pressed to unlock the locking body 38 from the lock 93. An opening 41 is formed in an upper wall of the outer housing body 31 at a position confronting the locking arm 35, as shown in FIG. 10. The locking arm 35 is visible through the opening 41 and the unlocking operation part 39 can be pressed through the opening 41.

The outer tube 32 has an inner surrounding portion 42 and a body 43. The inner surrounding portion 42 surrounds the peripheral surface of the inner tube 15. The body 43 is joined with an inner peripheral surface of the inner surrounding portion 42 and projects rearward from the inner surrounding portion 42. A small gap is defined between the inner peripheral surface of the inner surrounding portion 42 and the peripheral surface of the body 43. A step 44 is formed between the inner peripheral surfaces of the inner surrounding portion 42 and the body 43 so that the diameter of the body 43 is smaller than the diameter of the inner surrounding portion 42, as shown in FIG. 8. When the inner housing 11 is mounted on the outer housing 12, the rear end of the inner tube 15 is disposed directly forward from the step 44, the cushion 54 of the rubber stopper 50 is inserted into the body 43, and the peripheral surface of the cushion 54 closely contacts the inner peripheral surface of the body 43. The rear end of the cushion 54 is flush with the rear end of the body 43 or projects a little rearward from the rear end thereof.

Figure 3:
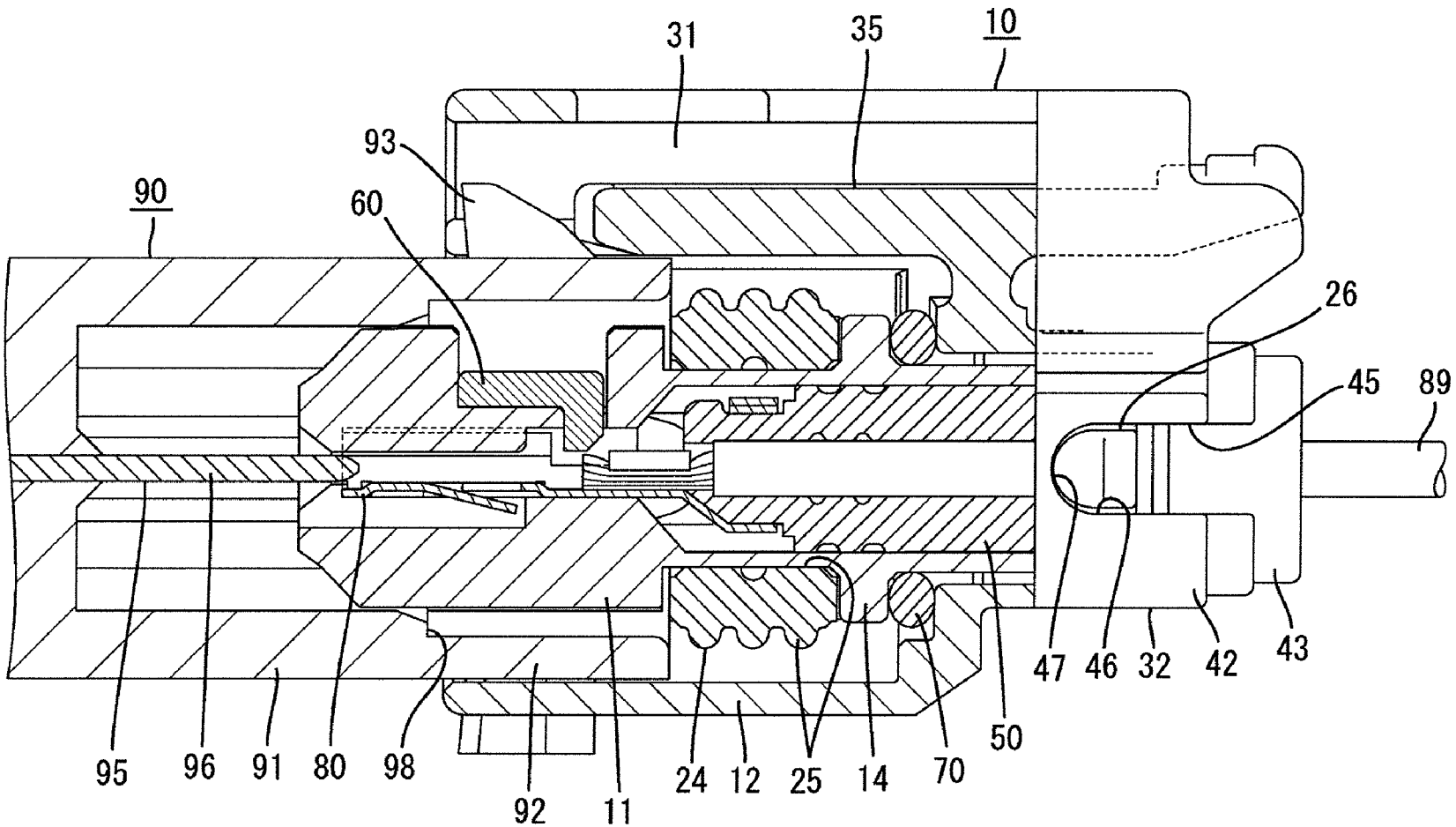
FIG. 3 is a sectional view showing the connector being fitted on the mating housing in an initial stage.

An outer lock 45 is formed on the outer tube 32 for receiving the inner lock 26, as shown in FIG. 3. The outer lock 45 is formed by cutting out both side surfaces of the inner surrounding portion 42 in the shape of a groove so that the outer lock 45 extends longitudinally and is open at the rear end of the inner surrounding portion 42. An outer locking body 46 is formed at a front part of the outer lock 45 and is partitioned from the front edge of the body 43. The outer lock body 46 has a configuration corresponding to the configuration of the inner lock 26 and hence the inner lock 26 can be fit elastically into the outer locking body 46 from the inner side. Thus, the inner housing 11 is held by the outer housing 12 in a combined state. The front edge of the outer locking body 46 defines a circular arc-shaped outer engaging surface 47 that fits on the inner engaging surface 29 of the inner locking body 27 (see FIG. 6). The inner and outer engaging surfaces 29 and 47 are curved so that position of the inner and outer housings 11 and 12 can change relative to each other when the inner and outer locks 26 and 45 are locked together.

The rubber member 70 is disposed between a forwardly facing surface of the outer tube 32 and the flange 14 of the inner housing 11 when the inner housing 11 is mounted on the outer housing 12. The rubber member 70 is made of rubber, such as silicone rubber, and is disposed at the side opposite to the seal ring 24 with respect to the flange 14. The rubber member 70 is ring shaped and is fit on the peripheral surface of the inner tube 15. More specifically, as shown in FIG. 1, the rubber member 70 is sectionally circular and has almost the same configuration over the entire circumference thereof. The rubber member 70 need not have sealing property and hence need not have lips on the peripheral surface thereof. Rather, the rubber member 70 is curved and does not have irregularities over the entire surface thereof. The rubber member 70 is compressed longitudinally elastically between the step 33 of the outer tube 32 and the flange 14 when the mating housing 90 is fit on the housing 10. At this time, the elastic restoring force of the rubber member 70 is applied to the front fit-on surface of the mating housing 90 and front fit-on surface of the inner housing 11 as a pressing force in a direction in which the mating housing 90 and the inner housing 11 strongly contact each other. Therefore when the mating housing 90 is fit on the housing 10, the front surfaces of the mating housing 90 and the inner housing 11 contact each other in a pressed state.

The connector is assembled by fitting the seal ring 24 and the rubber member 70 on the peripheral surface of the inner housing 11 at respective positions forward and rearward of the flange 14. The electric wires 89 and the rubber stoppers 50 are connected to the female terminal fittings 80 by caulking and the female terminal fittings 80 then are inserted into the cavities 16 of the inner housing 11 from the rear. The lances 86 hold each female terminal fitting 80 in the cavities 16. The retainer 60 then is pressed into the locking position to doubly lock each female terminal fitting 80.

The inner housing 11 then is inserted into the outer housing 12 from the front. As a result, the inner locking guide 28 slides on the inner peripheral surface of the outer tube 32 and expands the outer tube 32 elastically. The entire inner lock 26 elastically fits in the outer locking body 46 when the inner housing 11 is inserted normally into the outer housing 12. Thus, the outer housing 12 holds the inner housing 11. The inner tube 15 fits in the outer tube 32 of the outer housing 12, and the cushion 54 of the rubber stopper 50 is held inside the body 43 of the outer tube 32 so that the cushion 54 closely contacts the body 43. At this time, the rubber member 70 is sandwiched in the fit-on direction between the flange 14 and the outer tube 32 with the rubber member 70 being kept in a natural state. As shown in FIGS. 8 through 10, the front end of the inner housing 11 is forward from the front end of the outer housing 12 and is exposed to the outside.

Figure 2:
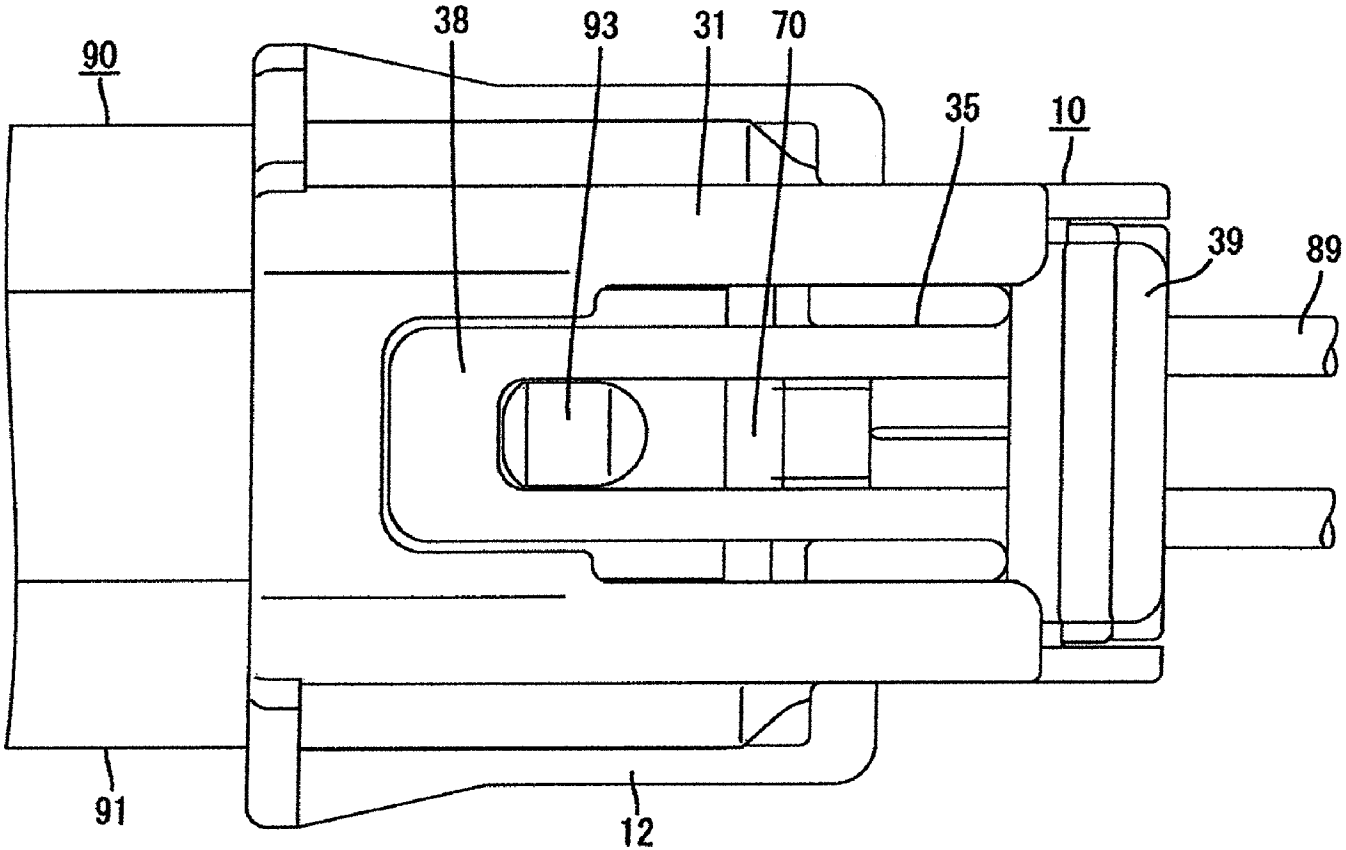
FIG. 2 is a plan view of the connector normally fitted on a mating housing.
Figure 4:
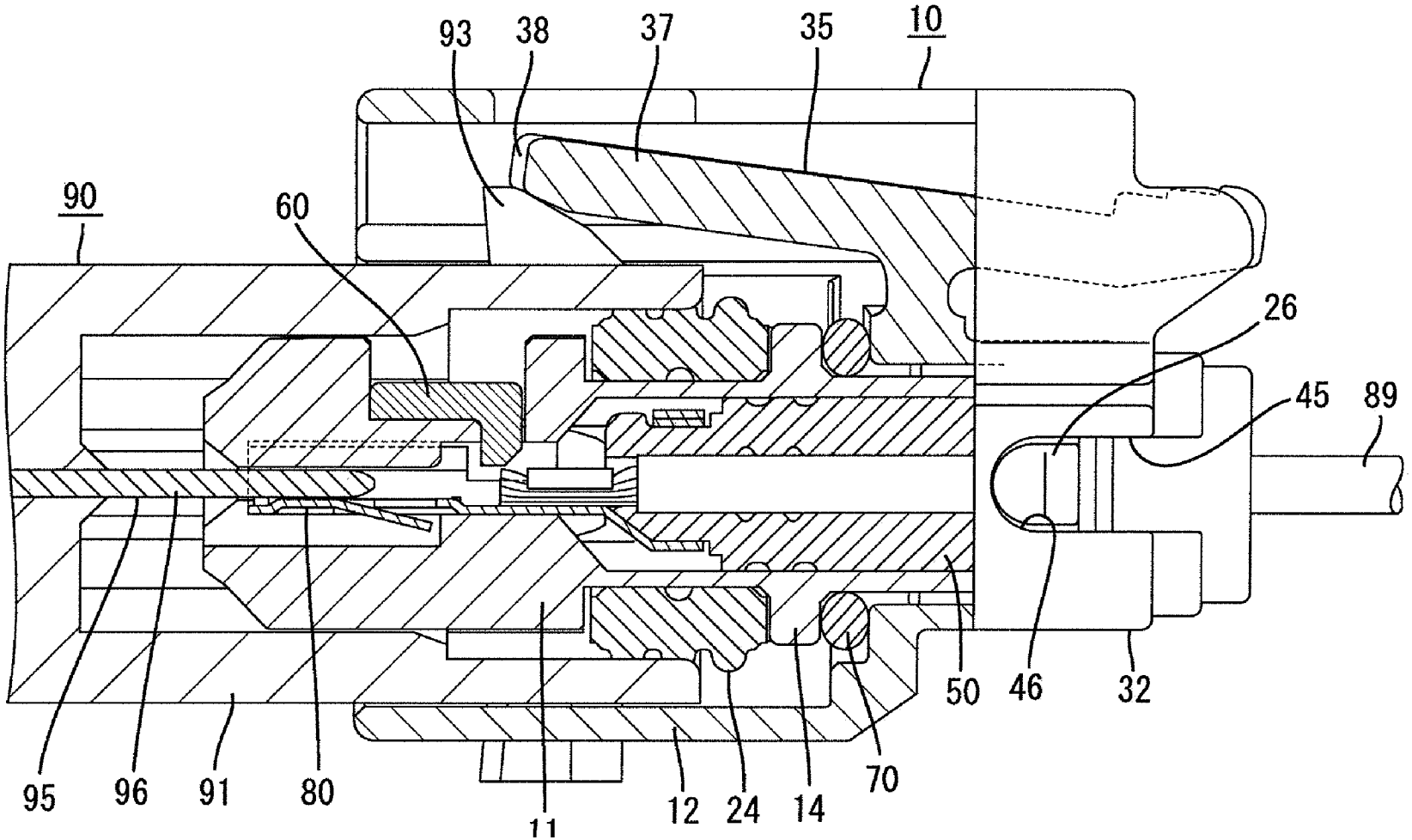
FIG. 4 is a sectional view showing the connector being fitted on the mating housing in a midway stage.
Figure 5:
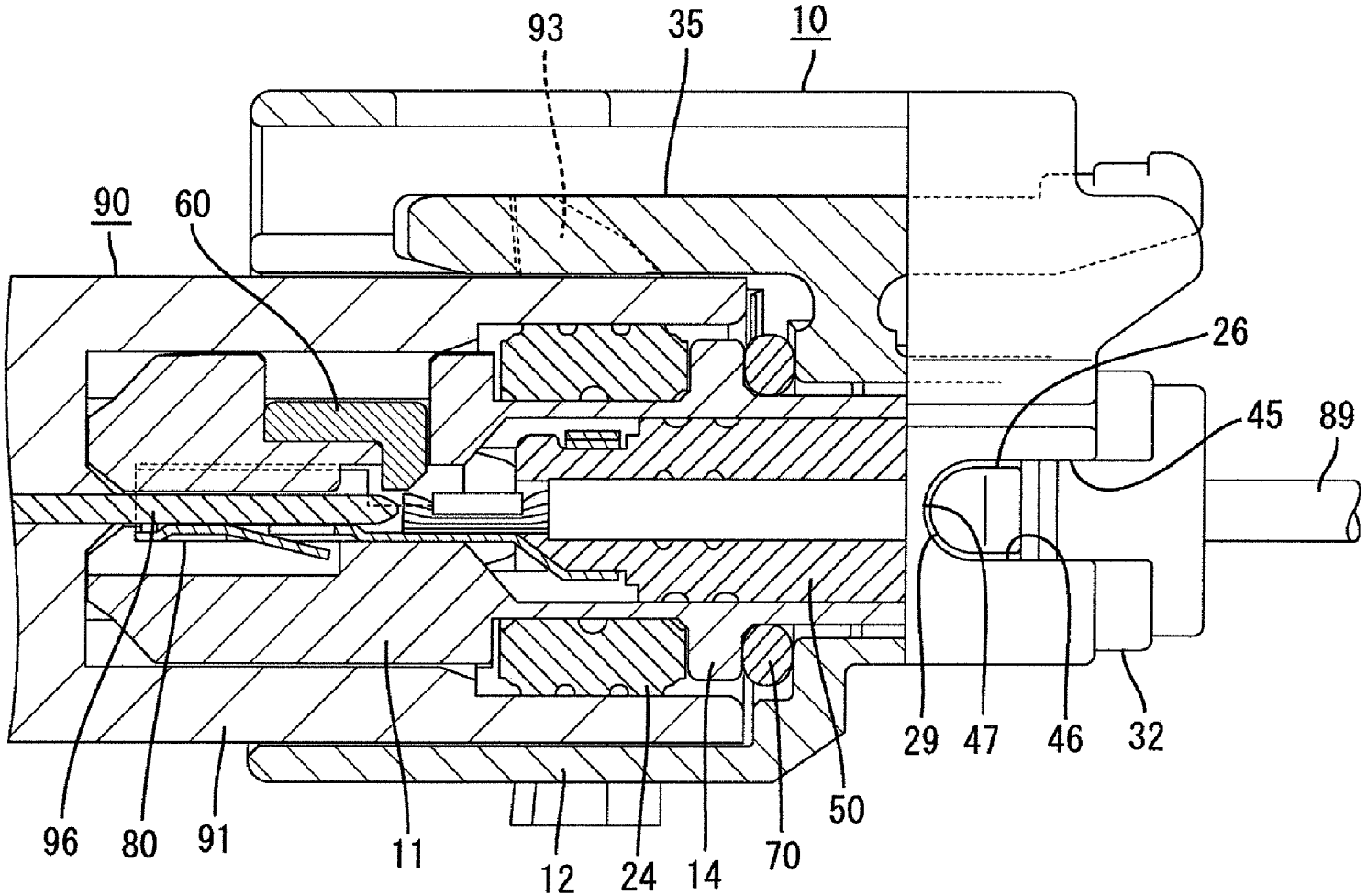
FIG. 5 is a sectional view of the connector normally fitted on a mating housing.
Figure 6:
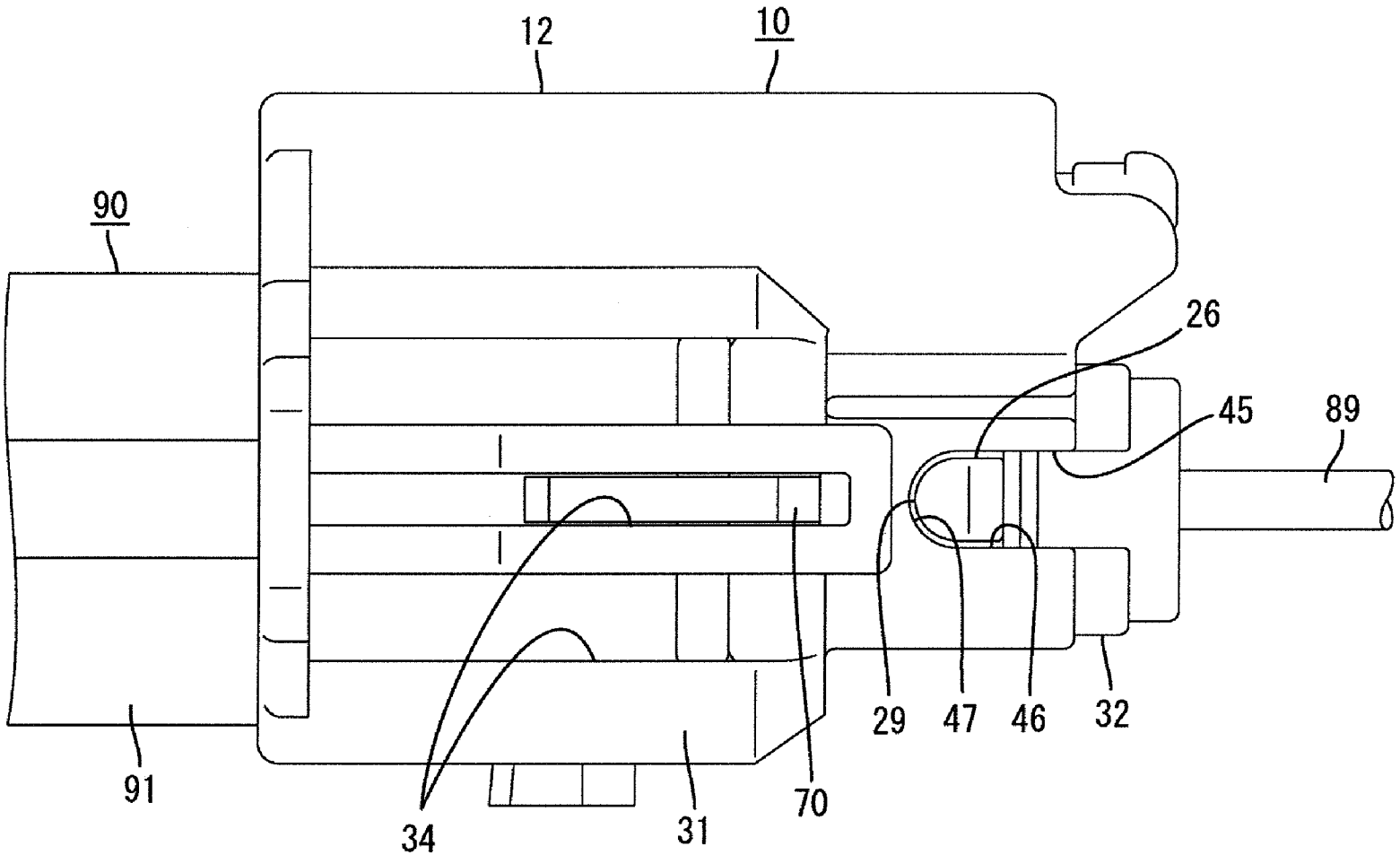
FIG. 6 is a side view of the connector normally fitted on a mating housing.

The assembled housing 10 then is positioned opposed to the mating housing 90, and the inner housing 11 is inserted into the hood 91 of the mating housing 90. The locking body 38 of the locking arm 35 interferes with the lock 93 in the process of fitting the inner housing 11 into the mating housing 90, as shown in FIG. 4. Thus, both arms 37 are lifted elastically. The arms 37 elastically restore to their original state when the mating housing 90 is fit normally on the housing 10. Thus the locking body 38 elastically locks the locking portion 93, as shown in FIGS. 2 and 5. At this time, the rubber member 70 is compressed in the fit-on direction between the flange 14 and the outer tube 32. Accordingly the elastic restoring force of the rubber member 70 acts between the locking body 38 and the lock 93 and between the front surfaces of the mating housing 90 and the inner housing 11. Thus, the locking body 38 and the lock 93 are locked tightly together, and the mating housing 90 and the inner housing 11 closely contact each other. In addition, a small gap is generated between the inner engaging surface 29 of the inner lock 26 and the outer engaging surface 47 of the outer lock 45. Further the tab 96 is inserted into the terminal body part 81 to a predetermined normal depth, so that the tab 96 and the contact pieces 85 are connected conductively to each other along a predetermined contact length in the longitudinal direction. When the mating housing 90 is fit normally on the housing 10, the front end of the hood 91 is disposed outward from the flange 14 with a gap formed between the front end of the hood part 91 and the step 33 of the outer housing 12. The front end of the hood 91 is at almost the same position as the front end of the rubber member 70, but the front end of the hood 91 does not contact the rubber member 70. As shown in FIG. 6, when the mating housing 90 is fit on the housing 10, the rubber member 70 is partly visible through the inward end of the bore 34 open at both side surfaces of the outer housing body 31.

There is a fear that vibration of devices coupled directly to the mating housing 90 could loosen the inner housing 11 inside the hood 91 of the mating housing 90 and could generate sliding contact that wears both terminal fittings 80 and 95. However, the rubber member 70 is compressed between the inner and outer housings 11 and 12 in the fit-on direction when the mating housing 90 is fit on the housing 10. The elastic restoring force of the rubber member 70 causes the front surfaces of the mating housing 90 and the inner housing 11 to contact each other closely in a pressed state. Therefore, vibration will not cause the inner housing 11 to displace relative to the mating housing 90 and or to loosen inside the hood 91. The front surfaces of the mating housing 90 and the inner housing 11 contact each other when the mating housing 90 is fit on the housing 10. Thus, the contact length of the tab 96 of the male terminal fitting 95 and the contact pieces 85 of the female terminal fitting 80 can be elongated in the longitudinal direction than a construction in which a gap is provided the mating housing 90 and the housing 10. Therefore the effective contact length for the terminal fittings 80 and 95 is obtained.

The positions of the inner and outer locks 26 and 45 can change relative to each other along the curved surface of the inner engaging surface 29 and that of the outer engaging surface respectively. Therefore the position of the inner and outer housings 11 and 12 can change relative to each other in the fit-on direction and in the direction orthogonal to the fit-on direction while being kept in a combined state. Accordingly, the inner housing 11 will not follow the movement of the outer housing 12 and the female terminal fitting 80 accommodated in the inner housing 11 will not be worn by sliding contact between the female and male terminal fittings 80 and 95.

When the electric wire 89 drawn out of the housing 10 vibrates, the vibration force of the electric wire 89 is transmitted to the outer housing 12 via the cushion 54 of the rubber stopper 50. Therefore the vibration force of the electric wire 89 transmitted to the inner housing 11 is decreased. Consequently, the female terminal fitting 80 accommodated in the inner housing 11 will not be worn by sliding contact between the female and male terminal fittings 80 and 95.

Furthermore the rubber member 70 fit on the peripheral surface of the inner housing 11 is ring-shaped. Therefore, the elastic restoring force of the rubber stopper 50 acts uniformly over the entire periphery of the front surfaces of the inner housing 11 and the mating housing 90. Therefore, the front surface of the inner housing 11 will not contact the mating housing 90 and the front surface of the mating housing 90 will not contact the front surface of the inner housing 11 in an inclined state.

The invention is not limited to the embodiments described above with reference to the drawings. For example, the following embodiments are also included in the technical scope of the present invention.

The rubber member may be composed of a rubber material having a higher hardness than that of the seal ring and the rubber stopper.

The cushion may be separate from the sealing part of the rubber stopper.

What is claimed is:

1. A connector comprising:

an inner housing having a rear end and a front end forward of the rear end, cavities extending through the inner housing from the rear end to the front end and terminal fittings accommodated therein;

an outer housing surrounding an outer periphery of the inner housing and movably disposed in forward and rearward directions relative to the inner housing, the outer housing having a lock formed thereon; and a rubber member sandwiched between a rearward facing surface of the inner housing and a forward facing surface of the outer housing, whereby the inner and outer housings can be connected with a mating housing so that the mating housing is fit between the inner and outer housings and engages the lock of the outer housing, and whereby the rubber member urges the front end of the inner housing against the mating housing when the mating housing is engaged with the lock of the outer housing.

2. The connector of claim 1, wherein the rubber member is ring-shaped and is fit on a peripheral surface of the inner housing.

3. The connector of claim 1, wherein the inner housing has an inner lock and the outer housing has an outer lock locked to the inner lock for keeping the inner and outer housings in a combined state, the inner and outer locks having curved surfaces configured for permitting positions of the inner and outer locks to change relative to each other when the inner and outer locks are locked together.

4. The connector of claim 1, wherein electric wires are connected to said terminal fittings and are drawn outside from said inner housing, a cushion being disposed on a periphery of said electric wire and closely contacting an inner peripheral surface of said outer housing.

5. The connector of claim 1, wherein the inner housing has a flange projecting out on an outer peripheral surface of the inner housing and the outer housing has a step, the rubber member being sandwiched between the flange and the step.

6. A connector assembly comprising:

a first housing having a terminal mounting portion with a front surface, a hood projecting forward from the terminal mounting portion and a lock formed on the hood;

an inner housing with opposite front and rear ends and an outer periphery extending between the front and rear ends, the inner housing being insertable in the hood of the first housing so that the front end of the inner housing abuts the front surface of the terminal mounting portion of the first housing;

an outer housing mounted on the outer periphery of the inner housing and fittable over the hood of the first housing, a resiliently deflectable lock formed on the outer housing and being engageable with the lock on the hood; and a rubber member compressed between opposed surfaces of the inner and outer housings and disposed for urging the front end of the inner housing against the front surface of the terminal mounting portion of the first connector when the resiliently deflectable lock on the outer housing engages the lock on the hood.

7. The connector assembly of claim 6, further comprising first terminal fittings mounted in the terminal mounting portion of the first housing and second terminal fittings accommodated in the inner housing, the first and second terminal fittings being connected when the resiliently deflectable lock on the outer housing engages the lock on the hood.

8. The connector assembly of claim 7, a flange projects out on the outer peripheral surface of the inner housing, the outer housing having a forwardly facing step rearward of the flange, the rubber member being sandwiched between the flange and the step.

9. The connector assembly of claim 8, wherein the rubber member is ring-shaped and is fit on the outer peripheral surface of the inner housing.

10. The connector assembly of claim 7, wherein the inner housing has an inner lock and the outer housing has an outer lock locked to the inner lock for keeping the inner and outer housings in a combined state.

11. The connector assembly of claim 10, wherein the inner and outer locks have curved surfaces configured for permitting positions of the inner and outer locks to change relative to each other when the inner and outer locks are locked together.

* * * * *